US012790908B2

(12) United States Patent
Tveranger

(10) Patent No.: US 12,790,908 B2
(45) Date of Patent: Nov. 10, 2026

(54) PACKER SETTING DEVICE

(71) Applicant: SBS Technology AS, Indre Arna (NO)

(72) Inventor: Jan Tore Tveranger, Garnes (NO)

(73) Assignee: SBS TECHNOLOGY AS, Indre Arna (NO)

( * ) Notice: Subject to any disclaimer, the term of this patent is extended or adjusted under 35 U.S.C. 154(b) by 0 days.

(21) Appl. No.: 19/118,685

(22) PCT Filed: Sep. 20, 2023

(86) PCT No.: PCT/NO2023/060050
§ 371 (c)(1),
(2) Date: Apr. 4, 2025

(87) PCT Pub. No.: WO2024/076240
PCT Pub. Date: Apr. 11, 2024

(65) Prior Publication Data

US 2026/0139561 A1 May 21, 2026

(30) Foreign Application Priority Data

Oct. 4, 2022 (NO) ..... 20221056

(51) Int. Cl.
*E21B 23/06* (2006.01)
*E21B 34/06* (2006.01)

(52) U.S. Cl.
CPC ..... *E21B 23/06* (2013.01); *E21B 34/063* (2013.01)

(58) Field of Classification Search
CPC ..... E21B 23/06; E21B 33/128; E21B 34/063
See application file for complete search history.

(56) References Cited

U.S. PATENT DOCUMENTS 9,732,579 B2 * 8/2017 Hiorth ..... E21B 33/12
10,107,070 B2 * 10/2018 Yong ..... E21B 33/12
10,544,654 B2 * 1/2020 Bjørgum ..... E21B 33/134
10,883,328 B2 * 1/2021 Brandsdal ..... E21B 29/02
(Continued)

FOREIGN PATENT DOCUMENTS

WO 2020117069 A1 6/2020
WO WO-2020197413 A1 * 10/2020 ..... E21B 34/063
WO WO-2020231268 A1 * 11/2020 ..... E21B 23/04

OTHER PUBLICATIONS

International Search Report and Written Opinion mailed Dec. 5, 2023, for PCT/NO2023/060050 (8 pages).
(Continued)

*Primary Examiner* — Jennifer H Gay
(74) *Attorney, Agent, or Firm* — ArentFox Schiff LLP

(57) ABSTRACT

A packer setting device comprising a tubular (10) with a plug housing (14), said plug housing (14) having an internal, through running boring (12) in an axial direction in the tubular (10). A breakable plug (16) is seated on a load ring (22), said breakable plug (16) being axially movable within the boring (12) between a first position in where the breakable plug (16) is with a distance to a breaking pin (18) and a second position in where the breakable plug (16) is forced against the breaking pin (18). The load ring (22) is compressible in said axial direction to allow the breakable plug (16) to move from the first position to the second position and to be forced against the breaking pin (18) for shattering of the breakable plug (16).

17 Claims, 7 Drawing Sheets

(56) References Cited

U.S. PATENT DOCUMENTS

| | | | | |
|---|---|---|---|---|
| 10,887,153 | B2 * | 1/2021 | Yong | H04L 67/025 |
| 10,927,642 | B2 * | 2/2021 | Tveranger | E21B 17/006 |
| 11,149,522 | B2 * | 10/2021 | Brandsdal | E21B 34/063 |
| 11,162,325 | B2 * | 11/2021 | Tunes | E21B 33/12 |
| 11,332,999 | B1 * | 5/2022 | Eriksen | E21B 33/1208 |
| 11,359,453 | B2 * | 6/2022 | Kent | E21B 34/10 |
| 11,365,598 | B2 * | 6/2022 | Brandsdal | E21B 33/134 |
| 11,428,071 | B2 * | 8/2022 | Hiorth | E21B 34/063 |
| 11,441,382 | B1 * | 9/2022 | Eriksen | E21B 34/102 |
| 11,499,394 | B2 * | 11/2022 | Tunes | E21B 33/12 |
| 11,680,462 | B2 * | 6/2023 | Tunes | E21B 33/12 166/317 |
| 11,692,414 | B2 * | 7/2023 | Hiorth | E21B 34/063 166/373 |
| 11,808,109 | B1 * | 11/2023 | Conner | E21B 34/063 |
| 11,851,968 | B2 * | 12/2023 | Eriksen | E21B 33/12 |
| 12,037,872 | B2 * | 7/2024 | Hiorth | E21B 33/1208 |
| 12,209,480 | B1 * | 1/2025 | Trahan | E21B 34/063 |
| 12,305,471 | B2 * | 5/2025 | Eriksen | E21B 17/1078 |
| 12,305,472 | B2 * | 5/2025 | Caruana | E21B 33/1208 |
| 12,359,526 | B2 * | 7/2025 | Eriksen | E21B 34/063 |
| 12,378,839 | B2 * | 8/2025 | Eriksen | E21B 33/12 |
| 12,385,343 | B1 * | 8/2025 | Eriksen | E21B 34/063 |
| 12,553,311 | B1 * | 2/2026 | Lindstrand | E21B 34/063 |
| 2016/0060998 | A1 * | 3/2016 | Hiorth | E21B 33/1208 166/192 |
| 2016/0281455 | A1 * | 9/2016 | Brandsdal | E21B 33/12 |
| 2017/0022783 | A1 * | 1/2017 | Yong | H04L 41/0213 |
| 2018/0245421 | A1 * | 8/2018 | Brandsdal | E21B 33/1204 |
| 2018/0324026 | A1 * | 11/2018 | Yong | E21B 34/063 |
| 2019/0032448 | A1 * | 1/2019 | Bjørgum | E21B 34/063 |
| 2020/0182007 | A1 * | 6/2020 | Kent | E21B 33/12 |
| 2020/0300059 | A1 * | 9/2020 | Tunes | E21B 33/1208 |
| 2021/0040816 | A1 * | 2/2021 | Hiorth | E21B 34/063 |
| 2021/0108476 | A1 * | 4/2021 | Brandsdal | E21B 33/1208 |
| 2021/0262316 | A1 * | 8/2021 | Brandsdal | E21B 34/063 |
| 2022/0081992 | A1 * | 3/2022 | Tunes | E21B 34/10 |
| 2022/0251922 | A1 * | 8/2022 | Hiorth | E21B 34/103 |
| 2022/0356780 | A1 * | 11/2022 | Hiorth | E21B 34/063 |
| 2022/0372845 | A1 * | 11/2022 | Tunes | E21B 29/08 |
| 2023/0089352 | A1 * | 3/2023 | Eriksen | E21B 34/063 166/378 |
| 2023/0193718 | A1 * | 6/2023 | Eriksen | E21B 33/134 |
| 2023/0243229 | A1 * | 8/2023 | Eriksen | E21B 33/134 166/179 |
| 2023/0243230 | A1 * | 8/2023 | Eriksen | E21B 33/1208 166/179 |
| 2023/0279736 | A1 * | 9/2023 | Eriksen | E21B 17/1078 166/192 |
| 2023/0400059 | A1 * | 12/2023 | Eriksen | E21B 34/063 |
| 2025/0137344 | A1 * | 5/2025 | Caruana | E21B 34/063 |

OTHER PUBLICATIONS

Norwegian Search Report mailed May 4, 2023, for 20221056 (2 pages).

* cited by examiner

PACKER SETTING DEVICE

CROSS-REFERENCE TO RELATED APPLICATIONS

This application is a U.S. national stage entry of PCT Application No. PCT/NO2023/060050 which was filed on Sep. 20, 2023. PCT Application No. PCT/NO2023/060050 claims priority to Norwegian Patent Application No. 20221056 which was filed on Oct. 4, 2022. This application claims priority to both PCT Application No. PCT/NO2023/060050 and to Norwegian Patent Application No. 20221056. Both PCT Application No. PCT/NO2023/060050 and Norwegian Patent Application No. 20221056 are incorporated into this application by reference.

FIELD OF THE INVENTION

The present invention relates to a packer setting device/downhole isolation valve comprising a tubular with a plug housing, said plug housing having an internal, through running boring in an axial direction in the tubular. A breakable plug is seated on a load ring, said breakable plug being axially movable within the boring between a first position in where the breakable plug is with a distance to a breaking pin and a second position in where the breakable plug is forced against the breaking pin.

BACKGROUND OF THE INVENTION

The present invention relates to a packer setting device/downhole isolation valve either with a glass seat and a dissolvable ball, or with a solid glass plug, and that is used in oil and gas production.

Packer setting devices/downhole isolation valves are used as a temporary barrier in a production tubing to be able to pressure up the production tubing for the purpose of setting a packer to seal of the annulus between the production tubing and a casing.

DISCLOSURE OF THE STATE OF ART

Prior art includes various solutions for activation systems, holding a glass-seat or a glass-plug in a housing to enable well operations like pressure test, packer setting and other. After well operations are completed, a mechanism for releasing the glass and breaking it is required.

WO2020117069A1 discloses a packer setting device, comprising a tubular with a plug housing, said plug housing having an internal, through running boring with an internal wall, and a breakable plug seated in a load ring axially movable within the boring between a first position in where the plug is with a distance to a breaking pin and a second position in where the plug is forced against the breaking pin. The load ring is resting on a shear ring with an annular shear lip to prevent axial movement in the first position until the shear lip is subjected to a force higher than a predetermined force, and said breaking pin is accommodated in a pocket on an outside of the load ring.

WO2020231268A1 discloses a well tool device comprising a housing with a through bore, a breakable plug slidable disposed in the through bore, sealing off said through bore, and a plug breaking mechanism for breaking said breakable plug. The plug breaking mechanism comprises: a one-way relief valve, for relieving a pressure in a closed chamber, a breaking member, for breaking the breakable plug, at least one support member for providing axial support for the breakable plug, the support member being radially yieldable when loosing radial support, a seal sleeve slidable disposed inside said housing, radially supporting said at least one support member, having an uphole piston area and a downhole piston area. Said uphole piston area is exposed to a pressure in the through bore and said downhole piston area is exposed to the pressure in a closed chamber. The seal sleeve further comprises a radial groove for receiving the at least one radially yieldable support member, and a ratchet mechanism or other retaining means preventing uphole movement of the seal sleeve.

WO2014154464A3 relates to a disintegratable plug apparatus for use in connection with petroleum wells, especially during pressure testing of such petroleum wells, wherein the plug apparatus comprises an outer housing surrounding at least one sealing device and a plurality of supporting bodies, at least one of the supporting bodies being in engagement with a locking device for locking to a locking sleeve, the at least one supporting body being brought out of engagement with the locking device after application of a predetermined pressure on the plug apparatus, whereby the at least one supporting body and the at least one sealing device are permitted an axial movement in the outer housing, this movement resulting in the at least one sealing device being brought into contact with loading devices adapted to subject the at least one sealing device to load so as to produce disintegration of the at least one sealing device.

U.S. Pat. No. 10,934,802B2 discloses a completion pipe comprising a plug arrangement and a method for arranging a completion pipe in a well. The arrangement includes a disintegratable plug element arranged in a plug housing in a pipe string, a seal element arranged to seal between the plug element and the pipe string. The plug element is movable in the axial direction of the pipe string between a first position and a second position.

WO2019083376A1 discloses a well tool device comprising a housing having a through channel with a first end and a second end, said housing further comprises a breakable ball seat, wherein a drop ball received in the ball seat partially or fully closes fluid communication in the through channel of the housing. The breakable ball seat is made of brittle and/or tempered glass, wherein the ball seat is broken by a pressure build up in the housing forcing the ball seat against one or more disintegrating means, said disintegrating means are provided as inside protrusions in the through channel.

OBJECTS OF THE PRESENT INVENTION

It is an object to provide a packer setting device/downhole isolation valve that can be used as a temporary barrier in a production tubing to be able to pressure up the production tubing for the purpose of setting a packer to seal of the annulus between the production tubing and a casing.

A further object is to provide a tubing with a housing having an internal, through running boring with an internal wall, and a compact and easy to manufacture packer setting device/downhole isolation valve with a breakable device axially movable within the boring between a first position in where the frangible device is with a distance to a breaking pin and a second position in where the frangible device is forced against the breaking pin.

The invention can for example also be installed to pressure test production tubing, or as a temporary well barrier while performing other commission activities in the well.

The application is to be used in downhole installations.

SUMMARY OF THE INVENTION

Said objects are achieved with a packer setting device comprising a tubular with a plug housing, said plug housing having an internal, through running boring in an axial direction in the tubular, and a breakable plug seated on a load ring, said breakable plug being axially movable within the boring between a first position in where the breakable plug is with a distance to a breaking pin and a second position in where the breakable plug is forced against the breaking pin. The load ring is compressible in said axial direction to allow the breakable plug to move from the first position to the second position and to be forced against the breaking pin for shattering of the breakable plug.

The load ring has a designated failure point that will yield at a determined force, allowing said compression of the load ring and the movement of the breakable plug from the first position to the second position, The load ring preferable comprises a movable plug seat part and a stationary part, said plug seat part and said stationary part are in an initial position provided at a distance between each other and separated by said designated failure point.

The plug seat part and the stationary part of the load ring are kept at a distance to each other when subjected to a force less than said determined force, and when subjected to a force higher than said determined force, the plug seat part is forced towards the stationary part allowing the breaking pin to be exposed for shattering of the breakable plug.

The plug seat part and the stationary part of the load ring can in one embodiment be separated by an internal, circumferential groove in the load ring.

The plug seat part can thus be shifted in the axial direction at a length corresponding to the width of the internal, circumferential groove in the load ring.

The designated failure point is in a first embodiment a shear plane provided between the plug seat part and the stationary part.

The shear plane can be a plane running in axial direction from the internal, circumferential groove and to an outside of the stationary part.

The length of the shear plane can be used to adjust and to alter the determined force needed for the designated failure point to yield.

The designated failure point may also be a shear surface provided between the plug seat part and the stationary part, said shear surface being the height of the internal, circumferential groove.

The height of the shear surface can be used to adjust and to alter the determined force needed for the designated failure point to yield.

The plug seat part and the stationary part of the load ring can in a second embodiment be separated by a buckling ring providing said designated failure point.

The length or thickness of the buckling ring can be designed according to Euler's buckling formula in order to calculate the determined force needed for the designated failure point to yield.

The buckling ring has a reduced thickness than the rest of the load ring, providing an internal and/or an external groove in the load ring.

The plug seat part can be shifted in the axial direction at a length corresponding to the buckling or compression of the buckling ring.

The packer setting device is used a temporary barrier in a production tubing.

The packer setting device may be used as a downhole isolation valve.

The breakable plug is frangible device, such as a glass seat for receipt of a dissolvable ball, or a solid glass plug.

Each breaking pin in the load ring can be accommodated in a boring running from the plug seat part and into the stationary part. Or each breaking pin in the load ring can be accommodated in an outside pocket running from the plug seat part and into the stationary part.

DESCRIPTION OF THE FIGURES

Embodiments of the present invention will now be described, by way of example only, with reference to the following figures, wherein.

DESCRIPTION OF PREFERRED EMBODIMENTS OF THE INVENTION

The present invention relates to a packer setting device/downhole isolation valve. The term packer setting device is however used in the rest of the description to cover both intended uses.

Figure 1:
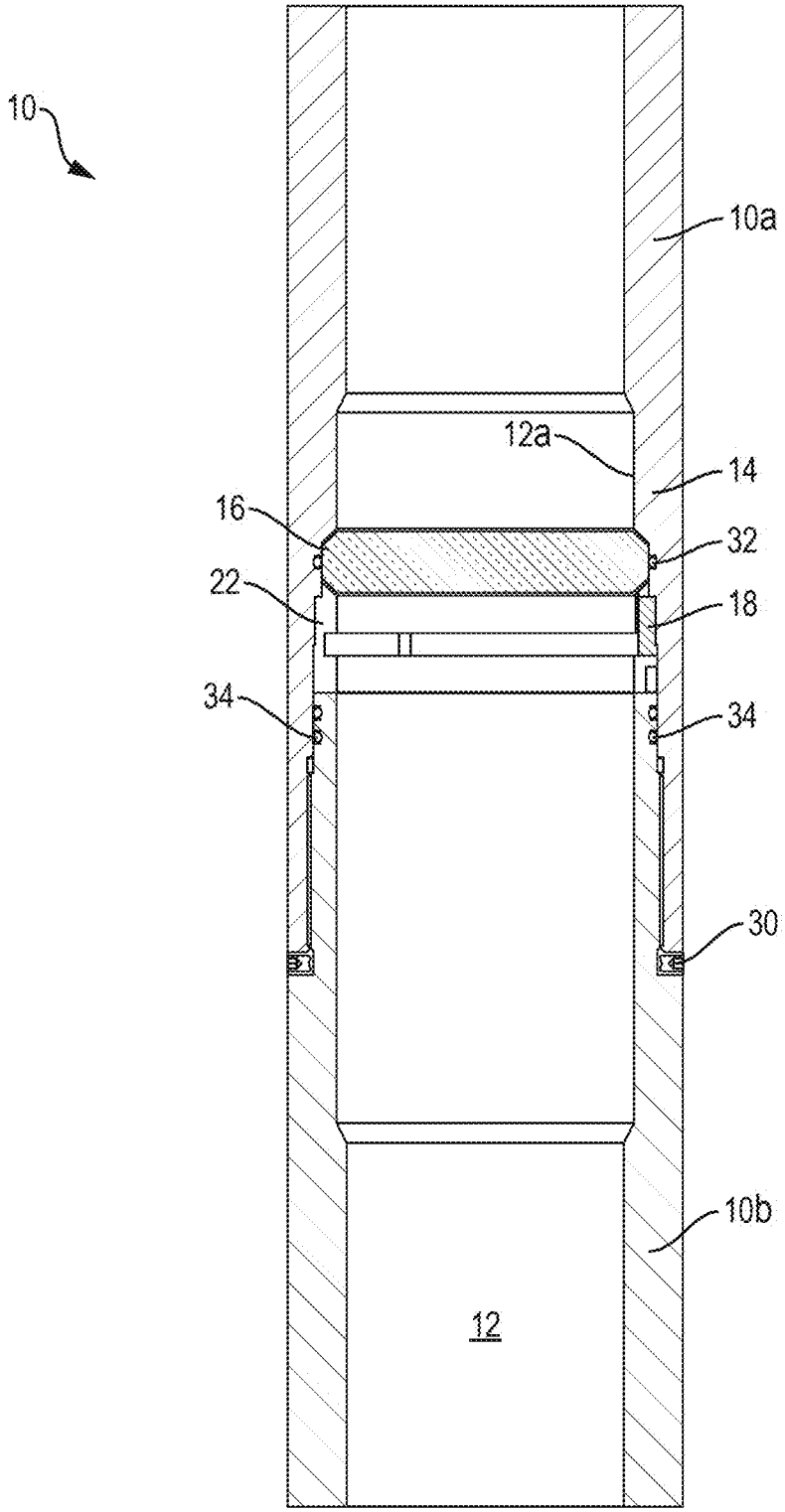
FIG. 1 shows a cross-sectional overview of a first embodiment of a packer setting device according to the invention.

FIG. 1 shows a first embodiment of a packer setting device according to the invention with a frangible device, such as a breakable, solid plug 16 made of glass or similar breakable material. The breakable plug 16 may also be a glass seat, in where a dissolvable ball is used to close the seat. The dissolvable ball is dropped into the packer setting device.

The breakable plug 16 is installed in a plug housing 14 of a tubing 10. The tubing 10 has an internal, through running boring 12 in an axial direction in the tubular 10, and with an upper part 10*a* and a lower part 10*b*, being upstream and downstream of the breakable plug 16. Seals 30,34 can be used in the plug housing 14 combining the two parts 10*a*, 10*b* of the tubing.

The breakable plug 16 is seated on a load ring 22, and the breakable plug is sealed against an internal or inside wall 12*a* of the boring 12 using seals 32. The breakable plug 16 is hence preventing fluid flow in the tubing 10. To open for fluid flow, the breakable glass plug 16 is from the upstream side being pressurized, thus forcing the breakable plug 16 against breaking means, such as breaking pins 18.

The load ring 22 is downstream of the breakable plug 16. The load ring 22 is annular shaped and the load ring 22 has one or several breaking pins 18 placed in internal borings or outside pockets, wherein said pockets can be shaped as a longitudinal and axial slits on the outside of the load ring 22.

Figure 2A:
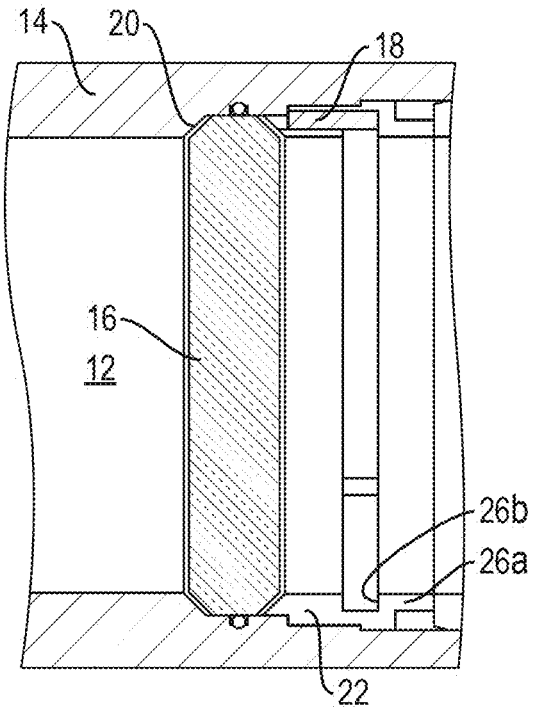
FIGS. 2*a* and 2*b* show a functional sequence of the first embodiment of packer setting device.
Figure 2B:
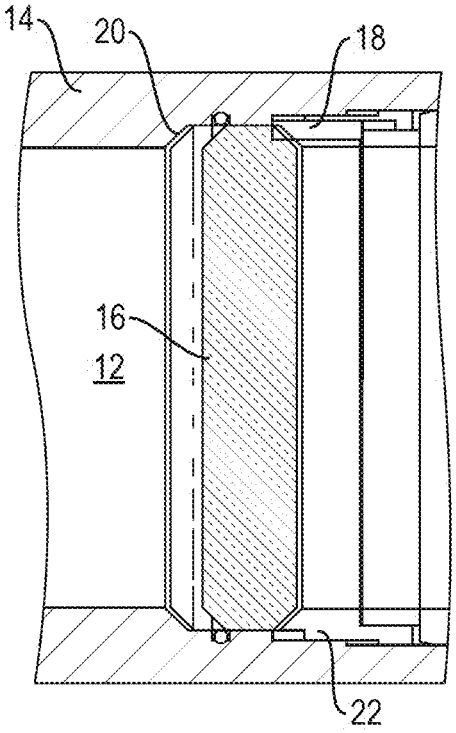
Figure 3A:
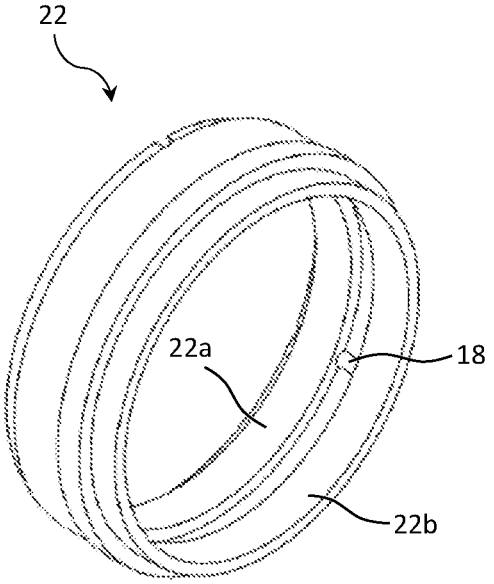
FIGS. 3*a* and 3*b* show a perspective view of the first embodiment of packer setting device in non-compressed and compressed state, respectively.
Figure 3B:
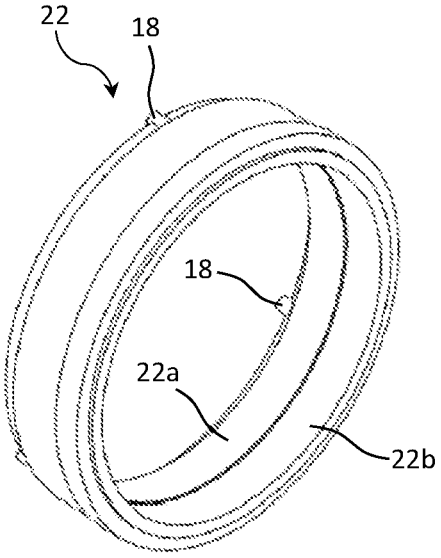
Figure 4A:
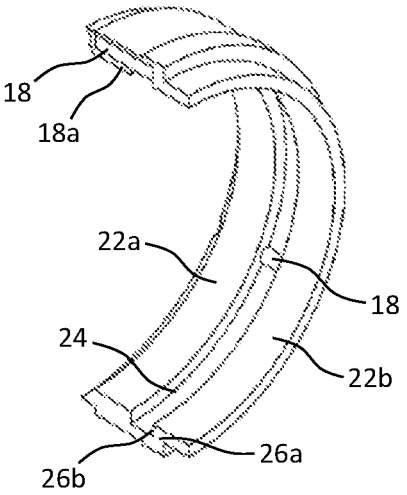
FIGS. 4*a* and 4*b* show a cut-out perspective view of the first embodiment of packer setting device in non-compressed and compressed state, respectively.
Figure 4B:
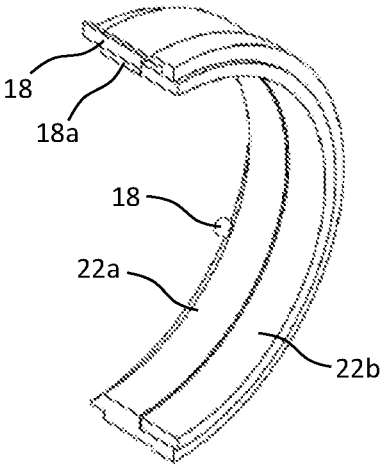
Figure 5A:
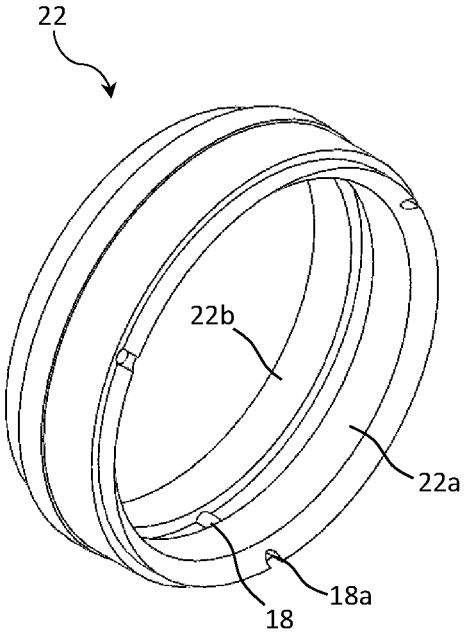
FIGS. 5*a* and 5*b* show a perspective view of the first embodiment of packer setting device in non-compressed and compressed state, respectively, as seen from opposite side than FIGS. 3*a* and 3*b*.
Figure 5B:
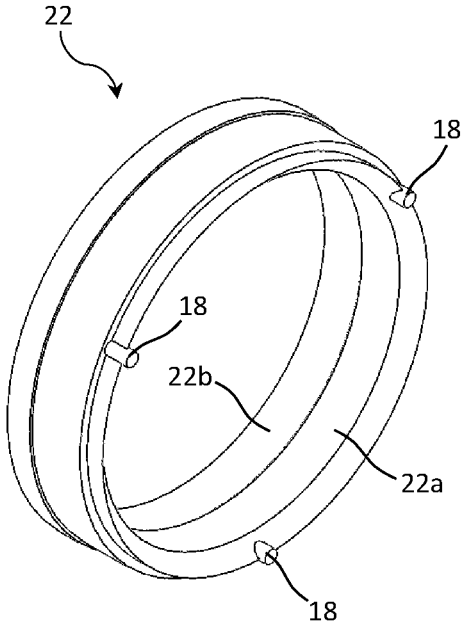
Figure 6:
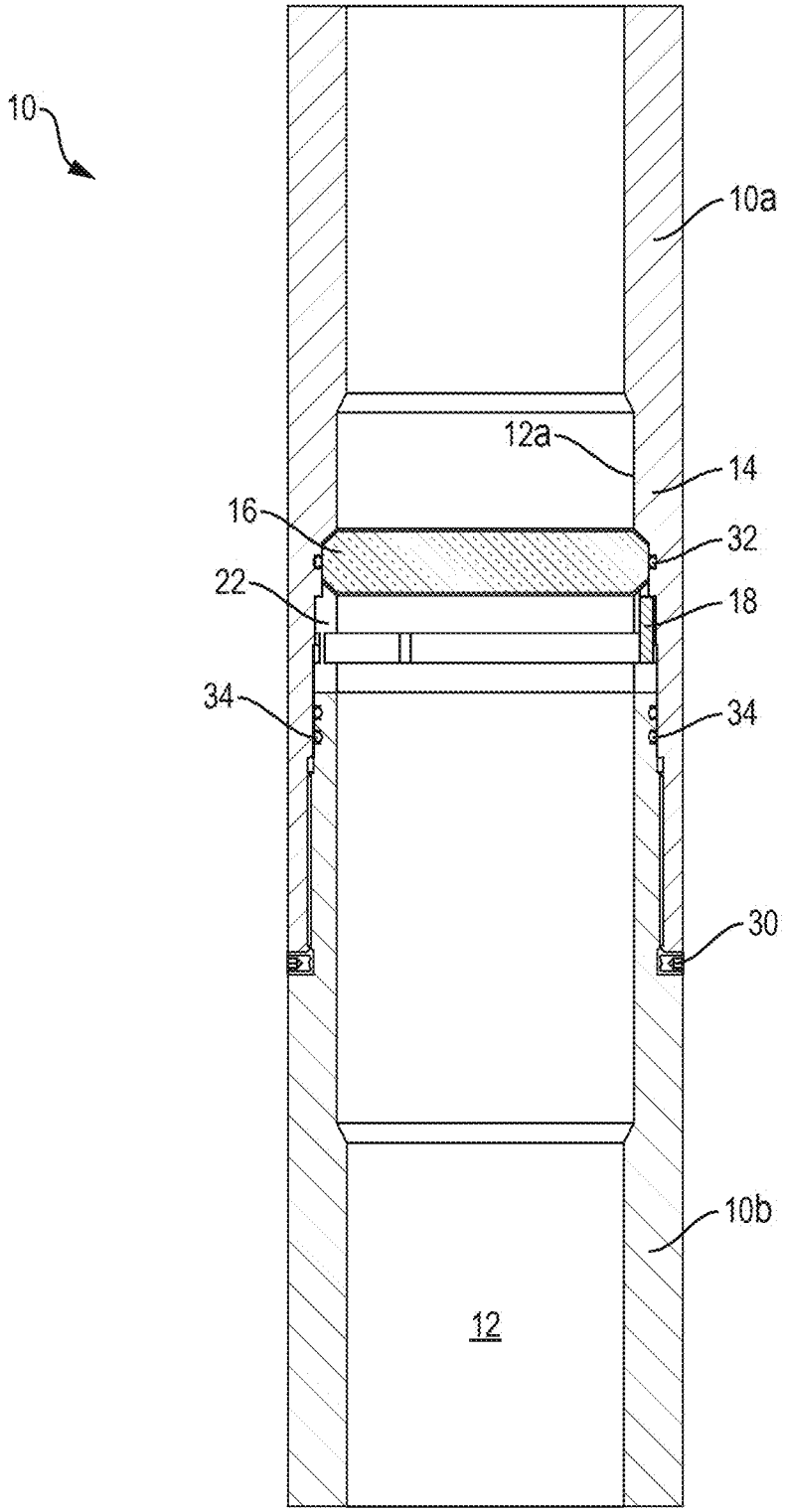
FIG. 6 shows a cross-sectional overview of a second embodiment of a packer setting device according to the invention.
Figure 7A:
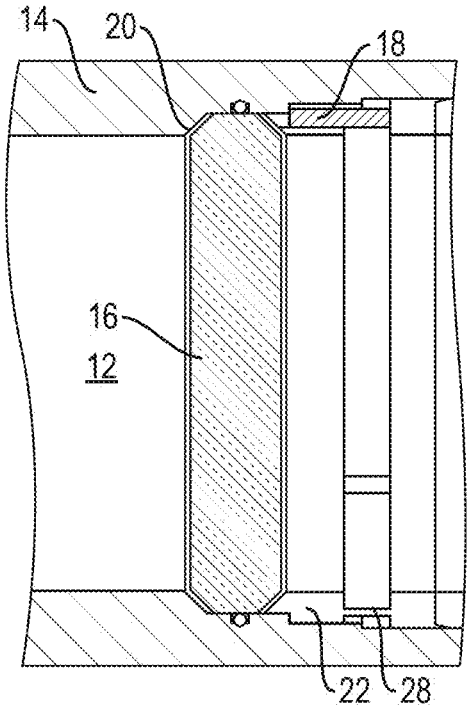
FIGS. 7*a* and 7*b* show a functional sequence of the second embodiment of packer setting device.
Figure 7B:
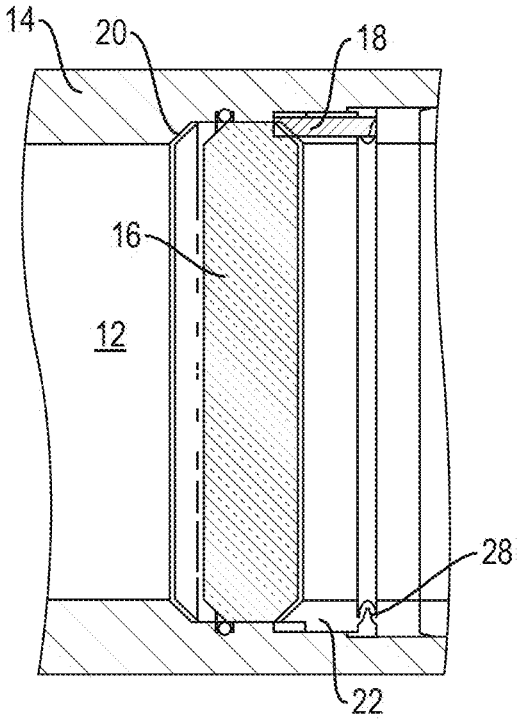
Figure 8A:
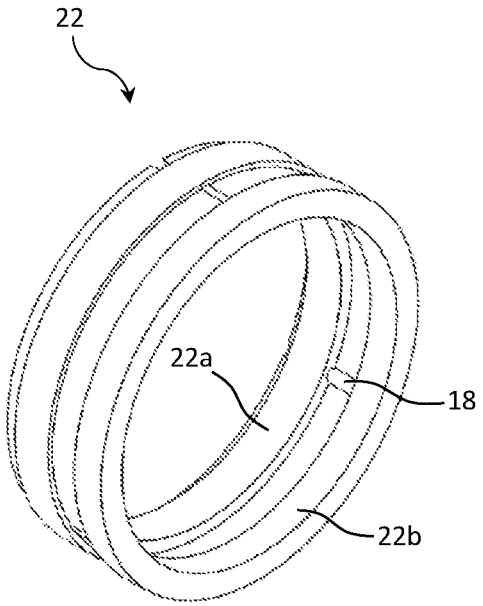
FIGS. 8*a* and 8*b* show a perspective view of the second embodiment of packer setting device in non-compressed and compressed state, respectively.
Figure 8B:
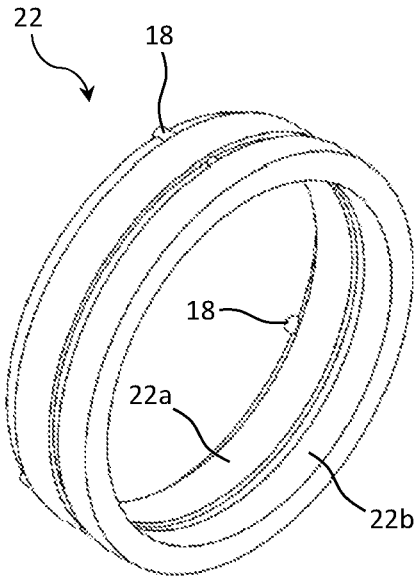
Figure 9A:
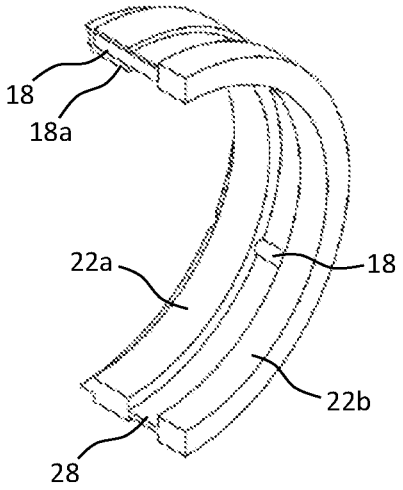
FIGS. 9*a* and 9*b* show a cut-out perspective view of the second embodiment of packer setting device in non-compressed and compressed state, respectively.
Figure 9B:
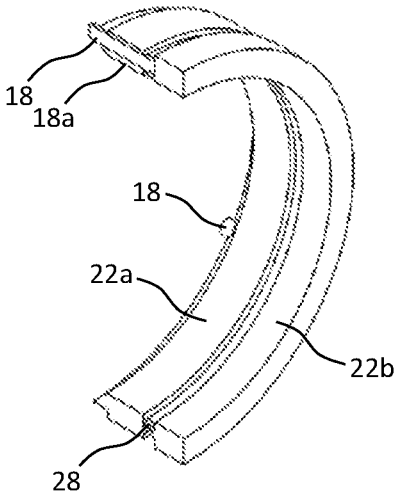

The breakable plug 16 is axially movable within the boring 12 between a first position in where the breakable plug 16 is located at a distance to the breaking pins 18 and a second position in where the breakable plug 16 is forced against the breaking pins 18, as shown in FIGS. 2*a* and 2*b* or in FIGS. 7*a* and 7*b*. The load ring 22 is compressible in axial direction to allow the breakable plug 16 to move from the first position to the second position and to be forced against the breaking pins 18 for shattering of the breakable plug 16.

The load ring 22 comprises two parts, a movable plug seat part 22*a* and a stationary part 22*b*. The stationary part 22*b* is placed stationary in the boring 12. The plug seat part 22*a* and the stationary part 22*b* are in an initial position provided at a distance between each other. In order to allow the compression of the load ring 22 and the movement of the breakable plug 16 from the first position to the second position, the load ring 22 has a designated failure point that will yield at a determined force. The designated failure point is different for the two embodiments of the invention and which shall be explained in more detail later.

The plug seat part 22*a* and the stationary part 22*b* of the load ring 22 are kept at a distance to each other and separated by said designated failure point, such that when subjected to a force higher than the determined force, the plug seat part 22*a* is forced towards the stationary part 22*b* allowing the breaking pin 18 to be exposed for shattering of the breakable plug 16. When the load ring 22 is subjected to a force less than said determined force, the plug seat part 22*a* and the stationary part 22*b* of the load ring 22 are kept at said distance to each other. In FIGS. 2*a* and 7*a* the breakable plug 16 is resting against a shoulder 20 in the boring 12, and in FIGS. 2*b* and 7*b* the breakable plug 16 has left its resting position against the shoulder 20 in the boring 12 (the breakable plug 16 is now on the right hand side of the dotted line).

The load ring 22 according to the first embodiment of the invention shall now be explained, particularly with reference to FIG. 3*a*-5*b*. The designated failure point is in the first embodiment a shear plane 26*a* provided between the plug seat part 22*a* and the stationary part 22*b* and/or the failure point is a shear surface 26*b* provided between the plug seat part 22*a* and the stationary part 22*b*, said shear surface 26*b* being the height of an internal, circumferential groove 24.

As seen, each breaking pin 18 in the load ring 22 is accommodated in a boring running from the plug seat part 22*a* and into the stationary part 22*b*. Optional, each breaking pin 18 in the load ring 22 can be accommodated in an outside pocket running from the plug seat part 22*a* and into the stationary part 22*b*.

The internal, circumferential groove 24 separates the plug seat part 22*a* and the stationary part 22*b*, wherein said plug seat part 22*a* is shifted in the axial direction at a length corresponding to the width of the internal, circumferential groove 24 in the load ring 22, thus forcing the breaking pin 18 out from the plug seat part 22*a* where the breakable plug 16 is resting and shattering the plug 16.

The shear plane 26*a* is a plane running in axial direction from the internal, circumferential groove 24 and to an outside of the stationary part 22*b*, wherein the length of the shear plane 26*a* is adjustable to alter the determined force needed for the designated failure point to yield. The height of the shear surface 26*b* can also be adjustable to alter the determined force needed for the designated failure point to yield.

The load ring 22 according to the second embodiment of the invention shall now be explained, with reference to FIG. 6-9*b*. As particularly shown in 8*a*-9*b*, the plug seat part 22*a* and the stationary part 22*b* of the load ring 22 are separated by a buckling ring 28 providing said designated failure point.

The length or thickness of the buckling ring 28 is preferably designed according to Euler's buckling formula in order to calculate and thus alter the determined force needed for the designated failure point to yield. Euler's critical load is the compressive load at which a slender column will suddenly bend or buckle. The formula is assumed known to a skilled person.

As seen, each breaking pin 18 in the load ring 22 is accommodated in a boring running from the plug seat part 22*a* and into the stationary part 22*b*. Optional, each breaking pin 18 in the load ring 22 can be accommodated in an outside pocket running from the plug seat part 22*a* and into the stationary part 22*b*.

The buckling ring 28 has a reduced thickness than the rest of the load ring 22, providing an internal and/or an external groove in the load ring 22. The plug seat part 22*a* is shifted in the axial direction at a length corresponding to the buckling/compression of the buckling ring 28, thus forcing the breaking pin 18 to out from the plug seat part 22*a* where the breakable plug 16 is resting and shattering the plug.

The invention claimed is:

1. A packer setting device comprising:

a tubing with a plug housing, said plug housing having an internal, through running boring in an axial direction in the tubing, a breakable plug seated on a load ring, said breakable plug being axially movable within the boring between a first position in which the breakable plug is located at a distance to one or more breaking pins and a second position in which the breakable plug is forced against the one or more breaking pins, characterized in that the load ring is compressible in said axial direction to allow the breakable plug to move from the first position to the second position and to be forced against the one or more breaking pins for shattering of the breakable plug;

wherein the load ring has a designated failure point that will yield at a determined force, allowing said compression of the load ring and the movement of the breakable plug from the first position to the second position;

wherein the plug seat part and the stationary part of the load ring are separated by a buckling ring providing said designated failure point; and wherein said plug seat part is shifted in the axial direction at a length corresponding to the buckling or compression of the buckling ring.

2. The packer setting device according to claim 1, wherein the load ring comprises a movable plug seat part and a stationary part, said plug seat part and said stationary part are in an initial position provided at a distance between each other and separated by said designated failure point.

3. The packer setting device according to claim 2, wherein said plug seat part and said stationary part of the load ring are kept at a distance to each other when subjected to a force less than said determined force, and when subjected to a force higher than said determined force, the plug seat part is forced towards the stationary part allowing the one or more breaking pins to be exposed for shattering of the breakable plug.

4. The packer setting device according to claim 2, wherein said plug seat part and said stationary part of the load ring are separated by an internal, circumferential groove in the load ring.

5. The packer setting device according to claim 4, wherein said plug seat part is shifted in the axial direction at a length corresponding to the width of the internal, circumferential groove in the load ring.

6. The packer setting device according to claim 4, wherein the designated failure point is a shear plane provided between the plug seat part and the stationary part.

7. The packer setting device according to claim 6, wherein the shear plane is a plane running in axial direction from the internal, circumferential groove and to an outside of the stationary part.

8. The packer setting device according to claim 7, wherein the length of the shear plane is adjustable to alter the determined force needed for the designated failure point to yield.

9. The packer setting device according to claim 4, wherein the designated failure point is a shear surface provided between the plug seat part and the stationary part, said shear surface being the height of the internal, circumferential groove.

10. The packer setting device according to claim 9, wherein the height of the shear surface is adjustable to alter the determined force needed for the designated failure point to yield.

11. The packer setting device according to claim 2, wherein each breaking pin of the one more breaking pins in the load ring is accommodated in a boring running from the plug seat part and into the stationary part.

12. The packer setting device according to claim 2, wherein each breaking pin of the one more breaking pins in the load ring is accommodated in an outside pocket running from the plug seat part and into the stationary part.

13. The packer setting device according to claim 1, wherein the length or thickness of the buckling ring is designed according to Euler's buckling formula in order to calculate the determined force needed for the designated failure point to yield.

14. The packer setting device according to claim 1, wherein the buckling ring has a reduced thickness relative to the plug seat part and the stationary part of the load ring, providing an internal and/or an external groove in the load ring.

15. The packer setting device according to claim 1, wherein the packer setting device is a temporary barrier in a production tubing.

16. The packer setting device according to claim 1, wherein the packer setting device is a downhole isolation valve.

17. The packer setting device according to claim 1, wherein the breakable plug is a frangible device or a solid glass plug.

* * * * *